US008248311B2

(12) United States Patent
Takei

(10) Patent No.: US 8,248,311 B2
(45) Date of Patent: Aug. 21, 2012

(54) PLANAR ARRAY ANTENNA AND COMMUNICATION TERMINAL AND WIRELESS MODULE USING THE SAME

(75) Inventor: Ken Takei, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 570 days.

(21) Appl. No.: 12/469,070

(22) Filed: May 20, 2009

(65) Prior Publication Data

US 2010/0079345 A1 Apr. 1, 2010

(30) Foreign Application Priority Data

Sep. 26, 2008 (JP) ..... 2008-247963

(51) Int. Cl.
*H01Q 1/24* (2006.01)

(52) U.S. Cl. ..... 343/702

(58) Field of Classification Search ..... 343/700 MS, 343/702, 770

See application file for complete search history.

(56) References Cited

U.S. PATENT DOCUMENTS

| | | | | |
|---|---|---|---|---|
| 7,312,763 | B2 * | 12/2007 | Mohamadi | 343/853 |
| 7,456,803 | B1 * | 11/2008 | Sievenpiper | 343/909 |
| 7,768,457 | B2 * | 8/2010 | Pettus et al. | 343/700 MS |
| 2003/0117321 | A1 * | 6/2003 | Furse et al. | 343/700 MS |
| 2004/0001021 | A1 * | 1/2004 | Choo et al. | 343/700 MS |
| 2004/0201526 | A1 * | 10/2004 | Knowles et al. | 343/700 MS |
| 2008/0079636 | A1 * | 4/2008 | Mohamadi | 343/700 MS |
| 2008/0266183 | A1 | 10/2008 | Takei | |

FOREIGN PATENT DOCUMENTS

JP 2006-245917 A 9/2006

* cited by examiner

*Primary Examiner* — Huedung Mancuso
(74) *Attorney, Agent, or Firm* — Mattingly & Malur, PC

(57) ABSTRACT

There is a need for preventing a feed line from generating undesirable radiation that may degrade array antenna characteristics. An array antenna is configured as a set of small planar conductor elements. Density distribution of the small planar conductor elements occurs at a cycle corresponding to a wavelength of a wireless system using the array antenna. The density distribution is formed along a specified length direction corresponding to a given azimuth angle.

15 Claims, 8 Drawing Sheets

FIG. 12
PRIOR ART

PLANAR ARRAY ANTENNA AND COMMUNICATION TERMINAL AND WIRELESS MODULE USING THE SAME

CLAIM OF PRIORITY

The present application claims priority from Japanese Patent Application JP 2008-247963 filed on Sep. 26, 2008, the content of which is hereby incorporated by reference into this application.

CROSS-REFERENCE TO RELATED APPLICATION

This application claims the benefit of U.S. patent application Ser. No. 12/081,901, filed Apr. 23, 2008, which is incorporated herein by reference.

FIELD OF THE INVENTION

The present invention relates to a planar array antenna and a communication terminal using the same. More specifically, the present invention relates to a planar array antenna and a communication terminal using the same capable of focusing an electromagnetic wave along a specific direction and improving directivity of the antenna.

BACKGROUND OF THE INVENTION

An antenna can radiate an electromagnetic wave along a specific direction in a focused way by configuring a maximum antenna size several times larger than or equal to an available wavelength used for the system. Such a structure uses an array of antennas each of which has a maximum direction for radiation of a single electromagnetic wave and features a length of a half wavelength or shorter. When the phases of the electromagnetic waves radiated from the antennas are adjusted, the antennas may be considered to provide a kind of antenna system that focuses electromagnetic waves along the specific direction. The system is generally referred to as an array antenna because the array of antennas is used.

A method of excitation disclosed in JP-2006-245917 A aims at providing a high-frequency substrate capable of fabricating a slot that can easily vary characteristics after the substrate is fabricated. The method uses a pattern configuration and a microstrip line so that the same plane is cyclically provided with conductor cells included in a conductive layer.

SUMMARY OF THE INVENTION

FIG. 12 shows an example configuration of a conventional array antenna. The array antenna includes multiple radiation elements (antenna elements) 70 connected to a feeding point 72 through a feed line 71. The radiation elements 70 are excited by co-phase excitation through the feed line.

The array antenna allows selection of phases radiated from virtual antenna elements. This makes it possible to control whether or not to concentratedly radiate the electromagnetic wave in a specific direction. A concentration degree of the electromagnetic wave depends on the number of virtual antenna elements. Increasing the concentration needs to increase the number of virtual antenna elements. The array antenna system requires the feed line as a power distribution circuit so as to supply the virtual antenna elements with the electromagnetic wave energy.

A conductor is used for the feed line belonging to the conventional array antenna so as to supply the electromagnetic wave energy to virtual antenna elements included in the array antenna. Generally, the feed line has a two-dimensional structure configured as two perpendicular axes so as to supply the energy to an array of virtual antenna elements. This is because the feed line needs to establish electrical connection from the feeding point, i.e., an electric power entry to one antenna element, to multiple antenna elements. The array antenna aims to concentratedly radiate an electromagnetic wave. It is desirable to provide virtual antenna elements included in the array antenna with a specific direction of radiating the electromagnetic wave. However, the feed line is essentially structured to extend in two axes. The feed line may radiate an electromagnetic wave in a direction different from a direction along which the electromagnetic wave should be radiated from the expected antenna elements. To solve this problem, an additional shielding structure may be used for preventing the feed line from radiating an electromagnetic wave. This complicates the array antenna structure and increases manufacturing costs. In addition, the shielding structure makes no contribution to electromagnetic wave radiation and adds a volume irrelevant to antenna operations. As a result, the array antenna itself increases in size.

It is therefore an object of the present invention to provide an array antenna and a wireless terminal and a wireless module using the array antenna capable of improving electrical and structural characteristics by eliminating the need for a feed line that may degrade the array antenna performance, increase manufacturing costs, and cause structural disadvantage.

A representative example of the present invention will be described as follows. A planar array antenna according to the invention includes a set of small planar conductor elements distributed in a plane. The density of distribution of the small planar conductor elements has a periodicity of variation in a specified length direction corresponding to a given azimuth angle with reference to a normal line belonging to the plane. A part of the small planar conductor elements is configured as a feeding point.

The invention can prevent a feed line from generating undesirable radiation that may degrade array antenna characteristics. It is possible to solve the characteristic degradation due to the feed line that radiates the electromagnetic wave in an unexpected direction. Further, there is no need for a structure that shields the feed line.

BRIEF DESCRIPTION OF THE DRAWINGS

FIGS. 1A to 1C show a configuration of a planar array antenna according to a first embodiment of the invention, in which FIG. 1A is an overhead view of the planar array antenna, FIG. 1B is an enlarged view of a conductor pattern, and FIG. 1C is a perspective view thereof;

DETAILED DESCRIPTION OF THE PREFERRED EMBODIMENTS

Figure 1A:
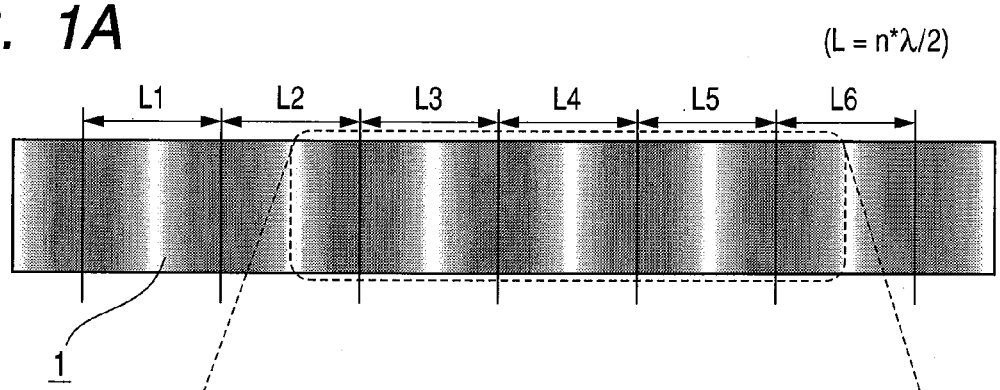

An antenna design technique arranges multiple tiny conductor elements. The antenna operates as a result of electrical interaction of the conductor elements. The most advanced computational power of recent years is used to generate the conductor elements on a plane or in a space. A computer is used to compute unmodified electromagnetic performances of a set of two-dimensional or three-dimensional small planar conductor elements. An exceedingly large number of types of conductor elements are generated in this manner for screening based on the results of the computed electromagnetic performances. The technique aims to find a set of small planar conductor elements featuring a targeted antenna characteristic. This technique is applied to an array antenna to generate densely or thinly distributed small planar conductor elements. The small planar conductor elements are generated along a specified length direction corresponding to a given azimuth angle direction with a cycle equivalent to the length of an electromagnetic wave used for the system to which the array antenna belongs. The technique can provide an antenna structure that does not include an explicit feed line and is capable of concentratedly radiating an electromagnetic wave.

The resulting antenna structure generates small planar conductor elements using only the relation of density of existence. The antenna structure clearly indicates the periodicity of virtual antennas so that the array antenna concentratedly radiates an electromagnetic wave in a specified direction. Consequently, the antenna structure intensively radiates an electromagnetic wave in the specified direction. The small planar conductor elements constructing the antenna structure are arranged in a planar or spatial configuration based on mutual electrical interactions as an exclusive determination criterion. The micro planar conductor itself functions as not only a radiation element for electromagnetic wave radiation but also as a feed line to receive the power. The array antenna structure does not include a feed line that supplies power to the virtual antennas. The structure solves the characteristic degradation due to the feed line that radiates the electromagnetic wave in an unexpected direction. Further, there is no need for a structure that shields the feed line.

The invention is embodied by discretizing the two-dimensional region into micro regions. The discrete regions are assigned two states 0 and 1. It is assumed that a region assigned 0 includes no conductor and a region assigned 1 includes a conductor. Addresses are assigned to the discrete regions and are associated with 0 and 1. Addresses are sequentially assigned in a specified length direction associated with a given azimuth angle with reference to a normal line belonging to the plane that includes the two-dimensional region. The address is incremented by one along the length direction from a start point of the length direction in the two-dimensional region. When the address reaches an end point of the length direction, the address returns to the next start point of the length direction adjacent to that start point of the length direction in the two-dimensional region. The similar addressing is performed sequentially. All the two-dimensional regions are addressed in this manner.

All the discrete regions are addressed in the two-dimensional region. The two-dimensional region is divided on a cycle along a specified length direction corresponding to the azimuth angle. Random numbers are generated so that the two-dimensional region provides the density distribution including 1 on that cycle. The density distribution is equivalent to a symmetric convex distribution whose maximum value corresponds to the center of the length direction for one cycle. On the other hand, random numbers are generated so as to provide a uniform distribution in a direction orthogonal to the length direction for one cycle in the two-dimensional region. These operations assign two different types of random numbers to the discrete regions.

The same function is used to find a value from the two random numbers. When the value exceeds a predetermined threshold value, the region is assigned 1. Otherwise, the region is assigned 0. The function includes a simple sum or a simple product, for example.

The planar array antenna according to the invention is embodied as follows. The above-mentioned operations are performed on all the discrete regions. A proper manufacturing method is then used to generate a conductor for the region that is assigned 1 from a blank state. The conductor is removed from a region that included the conductor and is assigned 0 afterwards.

Embodiments of the present invention will be described in further detail with reference to the accompanying drawings.

First Embodiment

Figure 1B:
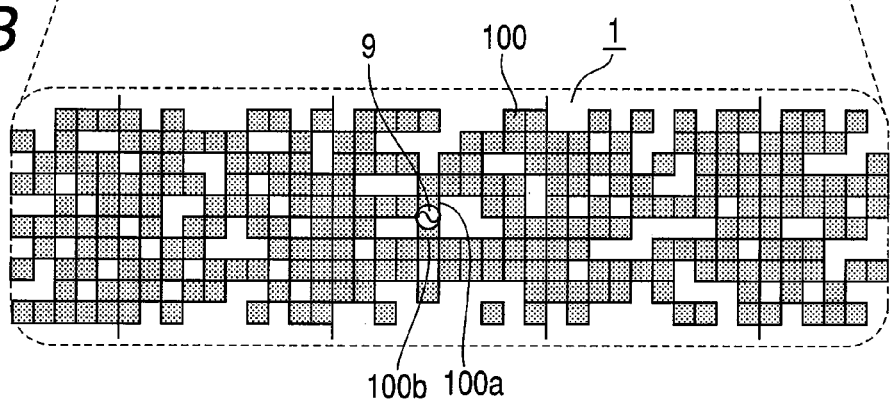
Figure 1C:
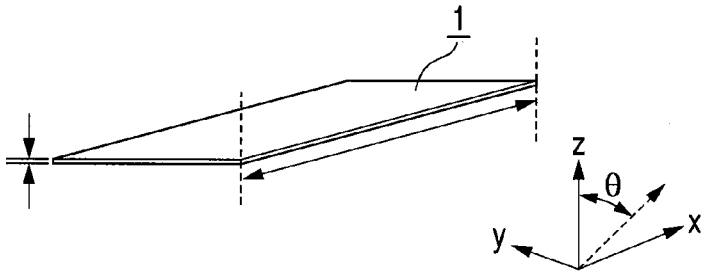
Figure 2:
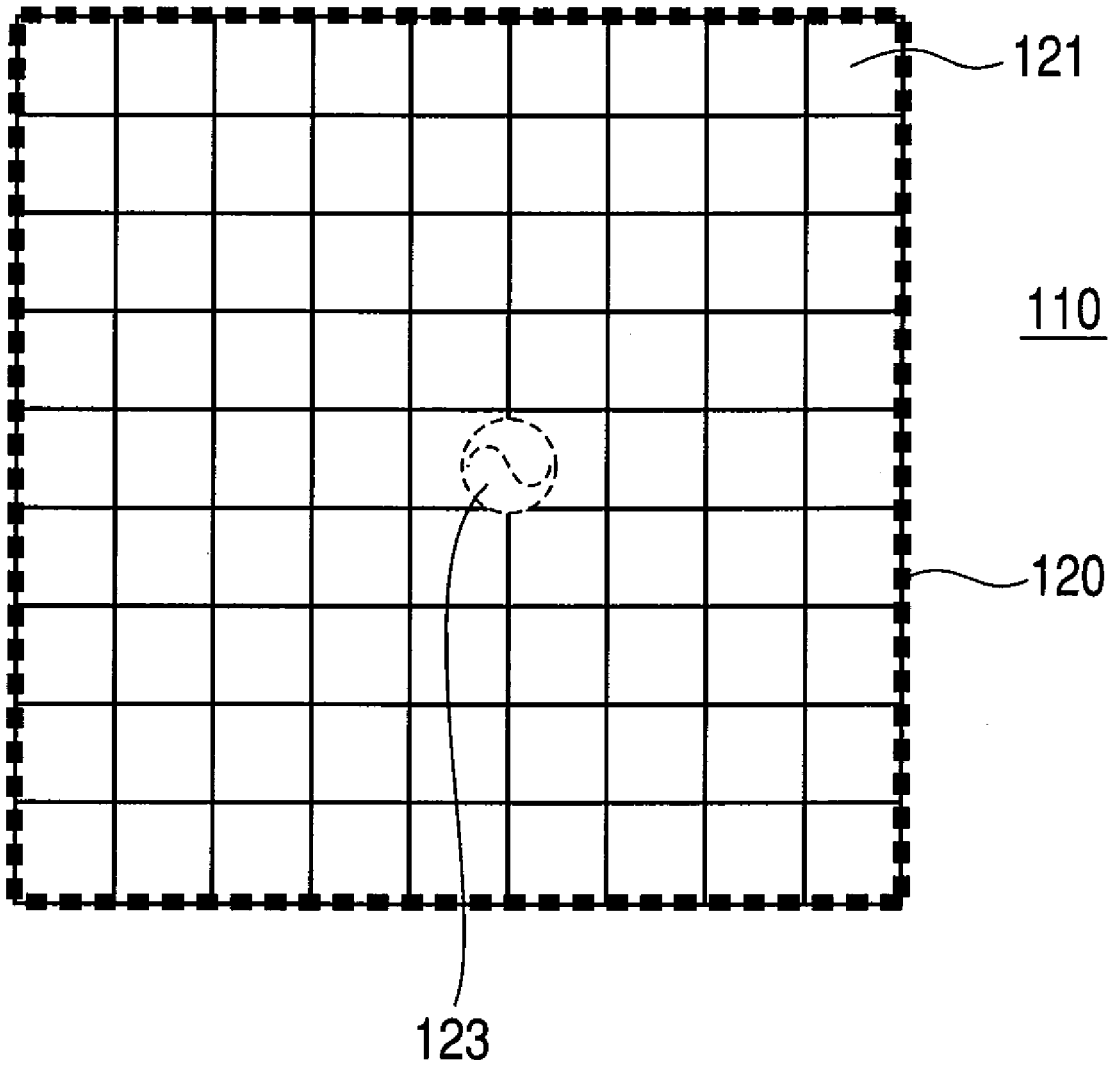
FIG. 2 shows a divided plane of the planar array antenna according to the first embodiment.
Figure 3:
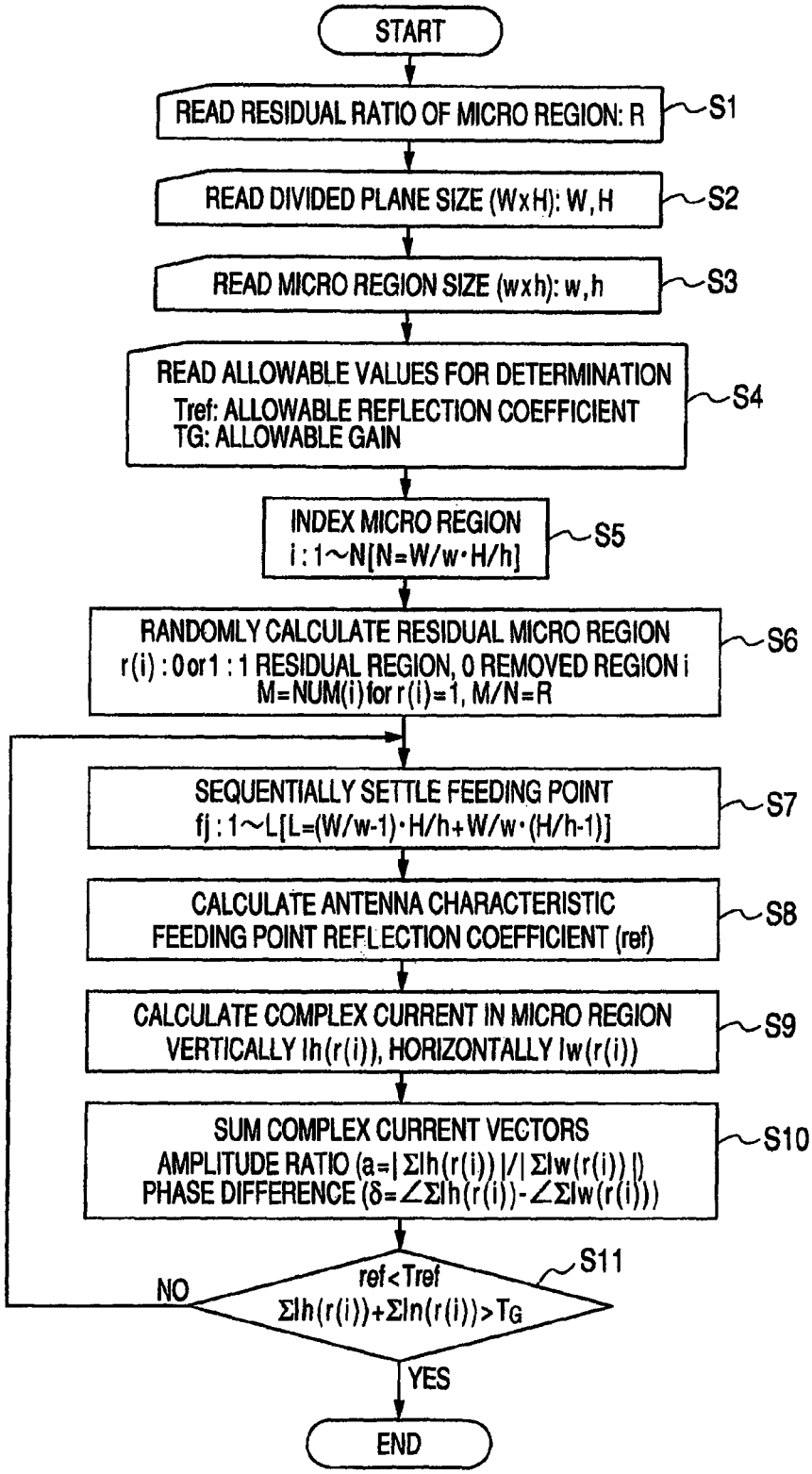
FIG. 3 is a flow chart showing a pattern generation method according to the first embodiment.

The first embodiment of the invention will be described with reference to FIGS. 1A to 1C through 3. FIG. 1A is an overhead view of the planar array antenna according to the invention. FIG. 1B shows an enlarged view of a conductor pattern for four cycles along a specified length direction (X-axis direction) corresponding to a given azimuth angle. FIG. 1C is a perspective view showing the shape of the planar array antenna according to the embodiment. FIGS. 2 and 3 show a design procedure of the planar array antenna according to the embodiment.

A planar array antenna (planar antenna) 1 according to the embodiment is equivalent to a narrow linear array antenna extending in a longer direction. The planar array antenna 1 features a unique length direction (X-axis direction) corresponding to a given azimuth angle (•). The planar array antenna 1 according to the embodiment is designed so as to one-dimensionally and concentratedly radiate an electromagnetic wave in the unique azimuth angle (•) direction. The planar array antenna 1 is not designed for radiation of the electromagnetic wave in a direction orthogonal to the azimuth angle (•) in the planar structure of the planar array antenna 1.

The planar array antenna 1 includes a set of multiple small planar conductor elements (antenna elements) 100. At least two adjacent small planar conductor elements form a feeding point 9. The planar array antenna 1 includes many aggregates of the small planar conductor elements 100 that are distributed two-dimensionally in the plane having X-axis and Y-axis components. The density of the small planar conductor elements has periodicity of variation in the length direction (X-axis direction) corresponding to the azimuth angle (•) with reference to the normal line (Z-axis direction) belonging to the antenna plane. In addition, the micro planar conductor functions as both a radiation conductor and a feed line. The plane shape of each micro planar conductor 100 according to the invention includes not only a rectangle but also regular polygons such as a square, a regular triangle, and a regular hexagonal. Still, the square or rectangular shape is advantageous because a conductor pattern can be computed easily and an electric current flows smoothly.

As seen from the enlarged view in FIG. 1B, the embodiment chooses two adjacent small planar conductor elements 100*a* and 100*b* from many small planar conductor elements 100 to form the feeding point 9. At least one edge of one micro planar conductor 100 adjoins the edge of another adjacent micro planar conductor 100. That is, two adjacent small planar conductor elements 100 share at least one edge. The shared edge functions as a feed line that interchanges electric power between the two adjacent small planar conductor elements. Any one of the small planar conductor elements 100 distant from the feeding point 9 is supplied with power from the feeding point 9 via the other small planar conductor elements as a feeding pathway and functions as a radiation element that contributes to the electromagnetic wave radiation. No feeding pathway is formed between the feeding point 9 and a micro planar conductor 100 that includes no edge in contact with the edges of the other small planar conductor elements. Such a micro planar conductor 100 does not function as a radiation element that contributes to the electromagnetic wave radiation.

The small planar conductor elements 100 or conductor patterns are distributed randomly. Nonetheless, there is the repetition of a dense (dark) region, a medium region, and a sparse (light) region along the length direction of the planar array antenna 1 as a whole. Let us view the planar array antenna 1 from too far away to identify each one of the small planar conductor elements. As shown in FIG. 1A, there is observed a one-dimensional contrasting density of patterns depending on the presence or absence of small planar conductor elements on a cycle proportional to a wavelength (operating wavelength) • of the wireless system that uses the planar array antenna 1. The planar array antenna 1 shows the contrasting density of patterns (density) that changes cyclically in width L (=L1=L2 and so on) along the length direction. Width L is expressed as L=n×•/2, where n is a natural number. The density of distribution of small planar conductor elements increases and decreases cyclically at an interval of multiples of the half wavelength. The contrasting density of patterns also applies to an electric current supplied to each antenna element (micro planar conductor element) and an electromagnetic wave radiated from each antenna element. The conductors are included in the entire plane of the planar array antenna at the rate of approximately 50%.

FIG. 1B shows a partitioning line between small planar conductor elements 100 for ease of understanding. Actually, the planar array antenna 1 includes a uniform thin film or a conductive layer of thin sheet with resistance that randomly extends in X-axis and Y-axis directions around the feeding point 9. The planar array antenna 1 is integrally formed without being divided into small planar conductor elements. Each micro planar conductor is specifically shaped into a rectangle having edges in X-axis and Y-axis directions up to several millimeters long each. The micro planar conductor is several micrometers to several tens of micrometers in thickness. Preferably, the micro planar conductor 100 is configured as a conductive thin film made of conductive materials such as a metal material with a small electrical resistance like copper, conductive paste, and conductive ink.

As shown in FIG. 1C, the planar array antenna 1 is specifically configured as a flat plate 17 to 30 micrometers thick and several millimeters to centimeters long in the longer direction. The feeding point 9 is formed in the array antenna structure. The micro planar conductor 100 according to the embodiment is formed by layering and pasting conductive materials such as metal material, conductive paste, and conductive ink.

According to electromagnetics, a current flows through the conductor in the same direction as the orientation of an electric field for an electromagnetic wave generated by the current at a distant point. A set of narrow conductor lines (small planar conductor elements) is formed on the same plane to configure the antenna. One point in the set of conductor lines is designated as a feeding point. Each conductor line is divided at points so as to be sufficiently smaller (one fiftieth or less) than the wavelength. Let us sum projections corresponding to two arbitrary orthogonal axes on the same plane including the complex vector for an induced current at each of the points. An antenna gain is equivalent to the sum of amplitudes for each sum corresponding to the two axes.

The following describes the antenna design technique according to the invention.

There may be various design algorithms for generating a specific antenna structure based on this new principle. A simplest algorithm provides a region used for an antenna. The region is divided into small rectangular regions, for example. A computer is used to randomly determine the presence or absence of a conductor in the divided region. A conductor distribution pattern corresponds to a set of narrow conductor lines that are generated. The size of the small region corresponds to the narrow width. A feeding point is randomly selected from the conductor distribution pattern. The new principle is used to create an array antenna candidate and verify whether or not the candidate antenna satisfies an actually requested gain.

The random selection based on the new principle provides a planar array antenna in the rectangular region as shown in FIGS. 1A to 1C.

The embodiment of the invention will be further described with reference to FIGS. 1A to 1C through 3.

The distribution phase array antenna according to the embodiment is structured as shown in FIGS. 1A to 1C. The feeding point 9 and a set of narrow conductor lines (small planar conductor elements) are formed on a virtual plane.

FIG. 2 shows a divided plane search for the planar array antenna according to the first embodiment.

The following describes the structure of the search. As shown in FIG. 2, a small square region 121 is used to divide a virtual plane 110 (W×H=9×9=81) and thus generate a divided plane 120. A computer is used to randomly compute two states, that is, leaving or removing each small square region on the divided plane 120. An antenna candidate pattern is generated in this manner.

The computer assigns a candidate feeding point 123 to all edges of the small square regions for each candidate pattern. Concerning the candidate pattern, the computer computes antenna characteristics such as the impedance matching state at the feeding point and the far field gain. The candidate pattern is used as a distribution phase antenna when the candidate pattern satisfies a permissible range of matching and gain. The embodiment can provide an array antenna that ensures a high gain and maintains intended directivity.

A flow chart in FIG. 3 shows a process of the antenna pattern generation method using a computer system according to the embodiment.

The process reads a remaining rate of area for small planar elements R of the micro region (S1). The process reads a divided plane size W×H (S2). The process reads a micro region size w×h (S3). The process reads a maximum gain TG (S4). The read values are assumed to be preset values.

A random removal operation predetermines the remaining rate of area for small square elements R of the small square region on the divided plane 120.

The process indexes the micro regions on the divided plane 120 (S5). For indexing, the process incrementally numbers small square regions 121 from 1 to N (=W/w×H/h).

The process performs random calculation on the micro regions (S6) to determine whether r(i) is set to 0 or 1, where 1 denotes a remaining area and 0 denotes a cutting area. The process finds M=NUM(i), i.e., the total number of remaining areas with r(i) set to 1 and computes remaining rate of area for small planar elements R=M/N.

At S5 and S6, the process randomly generates candidate antenna patterns at the predetermined remaining rate of area for small planar elements R in the divided plane size (W×H).

The process sequentially settles the candidate feeding point 123 (fj) in the micro region corresponding to the candidate pattern (S7). The feeding points (fj) are assigned from 1 to L, where L=(W/w−1)×H/h+W/w×(H/h−1).

Settling the feeding point determines a current distribution induced in each micro region. The process calculates antenna characteristics based on a reflection coefficient (ref) at the feeding point (S8). The process calculates a complex current in the micro region (S9) to find vertical direction Ih (r(i)) and horizontal direction Iw (r(i)) in each micro region.

After finding the complex current for each micro region, the process then sums complex current vectors (S10).

The process sums gains in two orthogonal directions w and h using G=|ΣIh(r(i))|+|ΣIw(r(i))|.

The process calculates an amplitude ref of the reflection coefficient using an inverse number (Ie-1) of the electric current value induced at the predetermined feeding point and a characteristic impedance (Zo) of a high-frequency circuit to be connected to an intended antenna.

$$\text{ref}=|(Ie-1-Zo)/(Ie-1+Zo)|$$

At S11, the process determines whether or not the complex vector value summed at S10 approximately is equal to the amplitude and provides the phase with a phase difference of approximately 90 degrees.

Specifically, the process determines whether or not the summed complex vector value complies with the permissible values read at S4. That is, amplitude ref of the reflection coefficient satisfies the allowable reflection coefficient Tref or the maximum gain TG as follows.

$$\text{ref}<T\text{ref},\ G>TG$$

When the condition is not satisfied (No at S11), the process returns to S7, changes the candidate feeding point 123, and repeats the above-mentioned flow. When the condition is satisfied (Yes at S11), the process terminates.

Dark and light parts are included in the contrasting density of patterns as large as the cycle size according to the embodiment. Conductors corresponding to the dark part occupy approximately 80% of the corresponding discrete region. Conductors corresponding to the light part occupy approximately 40% of the corresponding discrete region. The convex distribution is used to generate random numbers for the conductor pattern design. When the planar array antenna is viewed near enough to be able to identify each micro planar conductor, it is observed that the small planar conductor elements are distributed randomly locally. The feeding point 9 is formed of two adjacent small planar conductor elements that are not directly connected electrically.

The array antenna 1 according to the embodiment is structured very thin compared to the length and the width. The antenna per se may not ensure a sufficient mechanical strength for maintaining the original linear shape. It is desirable to ensure a mechanical strength for the array antenna according to the embodiment and use the antenna by maintaining its original shape. To ensure the mechanical strength, for example, the antenna may be attached to surfaces of other members or articles such as various devices, containers, packaging members, and shipping containers. The antenna may be also printed or embedded in these things.

As seen from FIGS. 1A to 1C, the array antenna according to the embodiment is void of a branch structure (feed line) in a size equivalent to the cycle. Such a branch structure would supply power to each micro planar conductor (antenna element) functioning as the radiation element from the feeding point 9.

The embodiment can solve the problems of the conventional array antenna: an antenna gain decrease due to an undesirable electromagnetic wave from the feed line; and a gain decrease in a specific radiation direction due to interference between an electromagnetic wave radiated from the feed line and an electromagnetic wave radiated from the radiation conductor.

Since the array antenna uses no feed line, the embodiment solves degradation of array antenna characteristics due to radiation of an electromagnetic wave in an undesired direction and eliminates the need for a structure that shields the feed line.

Second Embodiment

Figure 4:
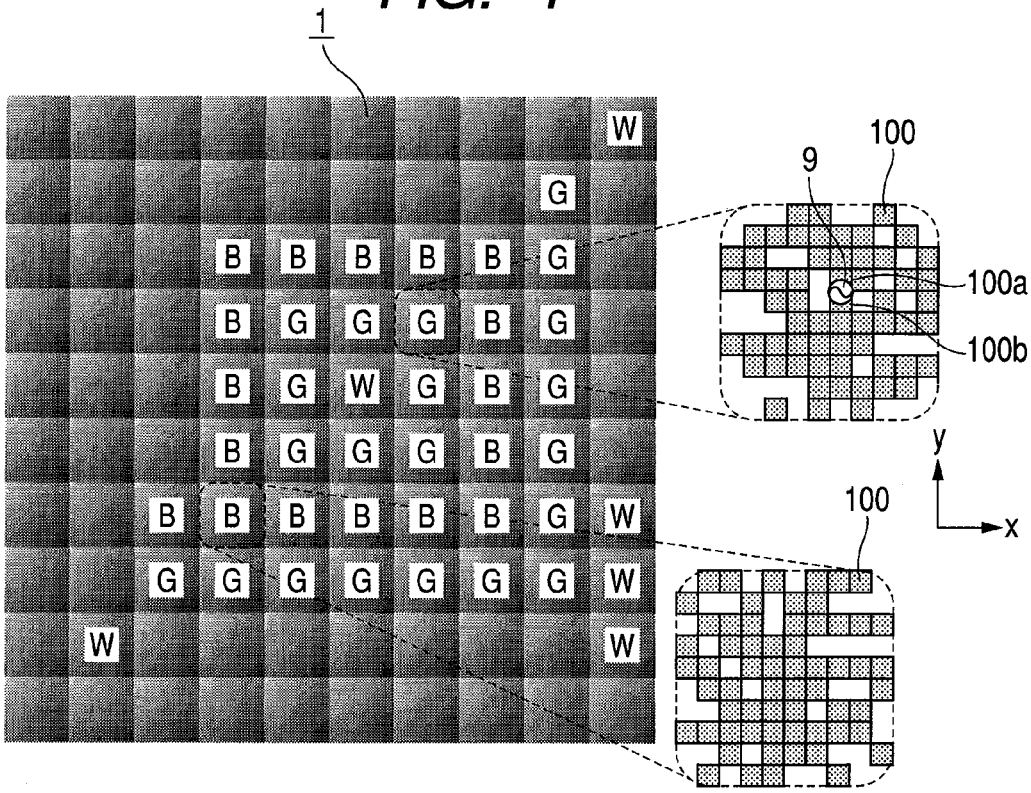
FIG. 4 is an overhead view of a planar array antenna according to a second embodiment of the invention and shows a conductor pattern corresponding to the size for a specific cycle in a two-dimensional periodic structure.

The second embodiment of the invention will be described with reference to FIG. 4. FIG. 4 shows an overhead view of a planar array antenna according to the second embodiment of the invention and a conductor pattern in the size equivalent to one specific cycle according to a two-dimensional periodic structure.

The planar array antenna 1 according to the embodiment is equivalent to a planar array antenna having two length directions such as X-axis and Y-axis directions orthogonal to each other at a given azimuth angle (•). The planar array antenna according to the embodiment is designed so as to two-dimensionally and concentratedly radiate an electromagnetic wave in the direction of the single azimuth angle (•). The planar array antenna 1 includes a set of small planar conductor elements 100 as enlarged to the right of FIG. 4. Let us view the planar array antenna 1 from too far away to identify each one of the small planar conductor elements. A two-dimensional shading pattern is observed along a diagonal of the rectangular plane from the top left to the bottom right thereof. The two-dimensional shading pattern is generated according to the presence or absence of the small planar conductor elements at a cycle equivalent to wavelength • of the wireless system that uses the planar array antenna. In FIG. 4, letter W denotes a light pattern; G denotes an intermediate pattern; and B denotes a dark pattern.

Dark and light parts are included in the contrasting density of patterns as large as the cycle size according to the embodiment. Conductors corresponding to the dark part occupy approximately 80% of the corresponding discrete region. Conductors corresponding to the light part occupy approximately 20% of the corresponding discrete region. A convex distribution is used to generate random numbers for the conductor pattern design. When the planar array antenna is viewed near enough to be able to identify each micro planar conductor, it is observed that the small planar conductor elements are distributed randomly locally. The feeding point 9 is formed of two adjacent small planar conductor elements that are not directly connected electrically.

Any one of the small planar conductor elements 100 distant from the feeding point 9 is supplied with power from the feeding point 9 via the other small planar conductor elements as a feeding pathway and functions as a radiation element that contributes to the electromagnetic wave radiation. No feeding pathway is formed between the feeding point 9 and a micro planar conductor 100 that includes no edge in contact with the edges of the other small planar conductor elements. Such a micro planar conductor 100 does not function as a radiation element that contributes to the electromagnetic wave radiation.

The planar array antenna 1 may be shaped to be not only rectangular as shown in FIG. 4 but also circular. In this case, the two-dimensional contrasting density of patterns expands concentrically.

The embodiment can solve the problems of the conventional array antenna through operations of the two-dimensional array antenna. The problems include: an antenna gain decrease due to an undesirable electromagnetic wave from the feed line; and a gain decrease in a specific radiation direction due to interference between an electromagnetic wave radiated from the feed line and an electromagnetic wave radiated from the radiation conductor.

Since the array antenna uses no feed line, the embodiment solves degradation of array antenna characteristics due to radiation of an electromagnetic wave in an undesired direction and eliminates the need for a structure that shields the feed line.

Third Embodiment

Figure 5A:
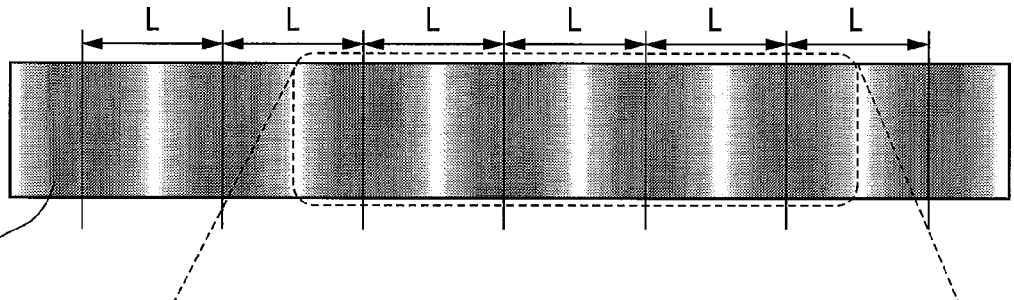
FIG. 5A is an overhead view of a planar array antenna according to a third embodiment of the invention.
Figure 5B:
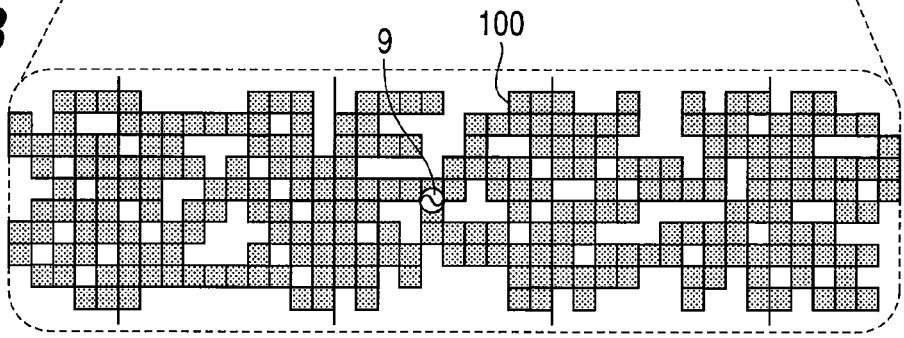
FIG. 5B shows a conductor pattern for four cycles along a specified length direction associated with a given azimuth angle.

The third embodiment of the invention will be described with reference to FIGS. 5A and 5B. FIG. 5A is an overhead view of a planar array antenna according to the third embodiment of the invention. FIG. 5B shows a conductor pattern for four cycles along a specified length direction associated with a given azimuth angle.

The planar array antenna according to the third embodiment uses the same design concept as the planar array antenna according to the embodiment in FIGS. 1A to 1C. The planar array antenna according to the embodiment includes a subset of small planar conductor elements that are electrically in contact with the other subsets through an edge or edges without exception. There is no subset of small planar conductor elements that is not electrically in contact with the other subsets. That is, a difference from the embodiment in FIGS. 1A to 1C is that it is void of a so-called floating island structure that includes no common edge between the micro planar conductor 100 or a set of the small planar conductor elements forming the planar array antenna and another micro planar conductor or another set of small planar conductor elements.

The floating island structure has no absolute potential for the feeding point of the antenna. The floating island structure easily varies its potential when a conductor, a dielectric material, or a magnetic material reaches the antenna. The antenna characteristics largely depend on the ambient environment.

Since the array antenna uses no feed line, the embodiment solves degradation of array antenna characteristics due to radiation of an electromagnetic wave in an undesired direction and eliminates the need for a structure that shields the feed line. In addition, the embodiment can prevent the planar array antenna from varying its characteristics in accordance with the ambient environment around the antenna and stabilize operations of the wireless system that uses the planar array antenna.

Fourth Embodiment

Figure 6A:
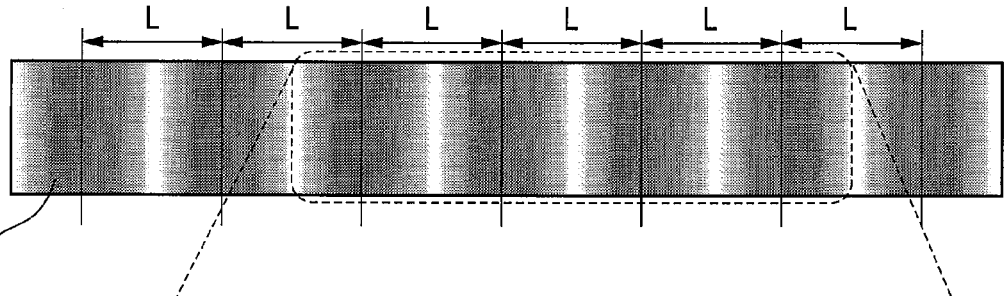
FIG. 6A is an overhead view of a planar array antenna according to a fourth embodiment of the invention.
Figure 6B:
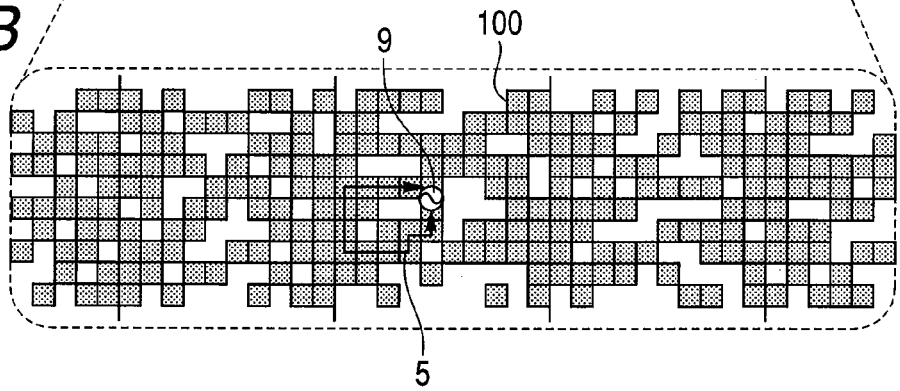
FIG. 6B shows a conductor pattern for four cycles along a specified length direction associated with a given azimuth angle.

The fourth embodiment of the invention will be described with reference to FIGS. 6A and 6B. FIG. 6A is an overhead view of a planar array antenna according to a fourth embodiment of the invention. FIG. 6B shows a conductor pattern for four cycles along a specified length direction associated with a given azimuth angle.

The planar array antenna according to the fourth embodiment uses the same design concept as the planar array antenna according to the embodiment in FIGS. 1A to 1C. A difference from the embodiment in FIGS. 1A to 1C is that a closed path 5 galvanically short-circuits the feeding point 9. The feeding point 9 is provided at a position where two small planar conductor elements 100 adjoin through two edges each of which belongs to each of both small planar conductor elements 100. While the two small planar conductor elements configure the feeding point, one edge of the micro planar conductor 100 is in contact with one edge of the other adjacent micro planar conductor 100. At least one edge is shared by the two small planar conductor elements 100. The two adjacent small planar conductor elements are in contact with each other through the common edge to form a short closed loop or a short-circuiting closed path 5.

Since the array antenna uses no feed line, the embodiment solves degradation of array antenna characteristics due to radiation of an electromagnetic wave in an undesired direction and eliminates the need for a structure that shields the feed line. Even when a surge power is applied to the feeding point 9, the feeding point 9 does not generate a high voltage. It is possible to protect a high-frequency circuit and a semiconductor chip connected to the planar array antenna from electrostatic breakdown.

Fifth Embodiment

Figure 7A:
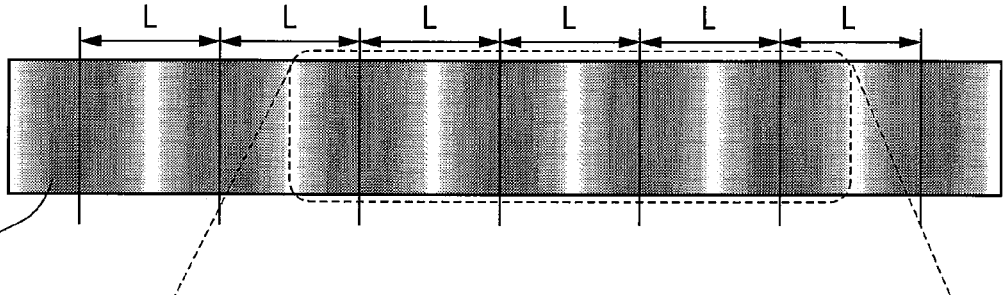
FIG. 7A is an overhead view of a planar array antenna according to a fifth embodiment of the invention.
Figure 7B:
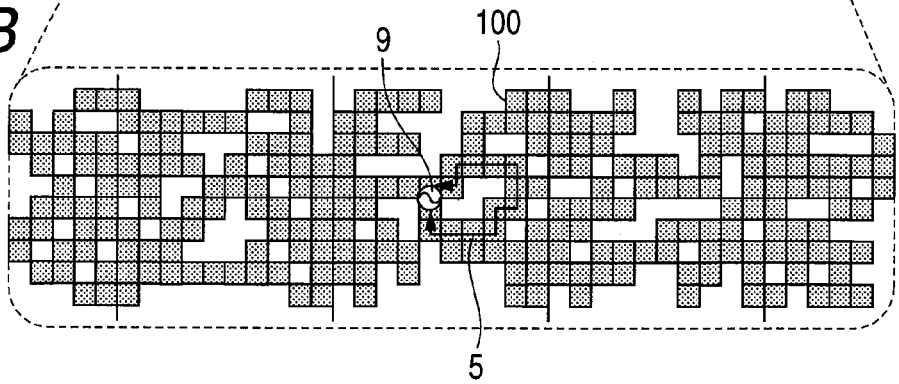
FIG. 7B shows a conductor pattern for four cycles along a specified length direction associated with a given azimuth angle.

The fifth embodiment of the invention will be described with reference to FIGS. 7A and 7B. FIG. 7A is an overhead view of a planar array antenna according to the fifth embodiment of the invention. FIG. 7B shows a conductor pattern for four cycles along a specified length direction associated with a given azimuth angle.

The planar array antenna according to the fifth embodiment uses the same design concept as the planar array antenna according to the embodiment in FIGS. 1A to 1C. A difference from the embodiment in FIGS. 1A to 1C is that the planar array antenna is void of a so-called floating island structure that includes no common edge between the micro planar conductor 100 or a set of the small planar conductor elements forming the planar array antenna and another micro planar conductor or another set of small planar conductor elements. In addition, the short-circuiting closed path 5 galvanically short-circuits the feeding point 9.

The fifth embodiment can provide both effects of the embodiments in FIGS. 5A and 5B and 6A and 6B.

Sixth Embodiment

Figure 8A:
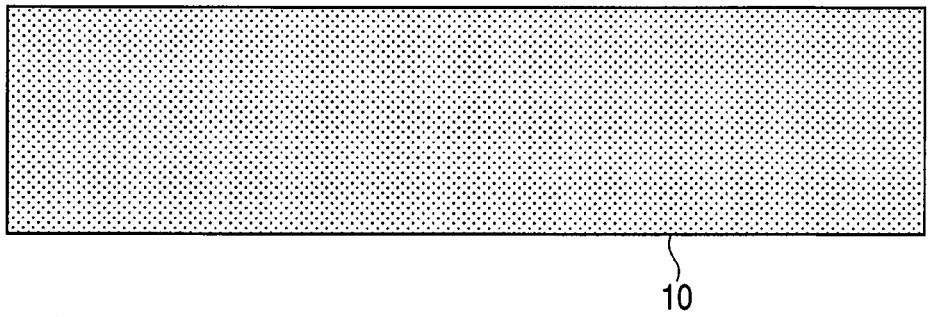
FIG. 8A shows a conductor plate for fabricating a planar array antenna according to a sixth embodiment of the invention.
Figure 8B:
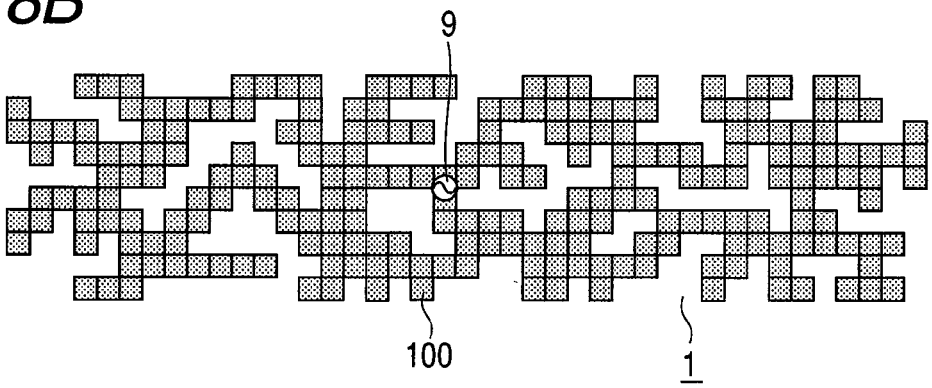
FIG. 8B shows a conductor pattern of the planar array antenna according to the sixth embodiment of the invention.

The sixth embodiment of the invention will be described with reference to FIGS. 8A and 8B. FIG. 8A shows a conductor plate 10 for fabricating the planar array antenna 1. FIG. 8B shows a conductor pattern of the planar array antenna according to the sixth embodiment of the invention.

The planar array antenna according to the sixth embodiment uses the same design concept as the planar array antenna according to the embodiment in FIGS. 1A to 1C. A difference from the embodiment in FIGS. 1A to 1C is that each of all the small planar conductor elements 100 forming the planar array antenna has a common edge in contact with another micro planar conductor or another set of small planar conductor elements. In other words, the planar array antenna 1 is void of a so-called floating island structure that includes no common edge in contact with another micro planar conductor or set of small planar conductor elements. In addition, unlike the planar array antenna 1 of the embodiment in FIGS. 1A to 1C, the planar array antenna 1 in this embodiment does not have the structure in which one micro planar conductor is connected with another only through a corner. The feeding point 9 may be galvanically short-circuited by the short-circuiting closed path 5 configured to be shorter in length.

The planar array antenna 1 according to the embodiment may be expressed as the continuously flat conductor (conductor plate) 10 irregularly formed of multiple holes or areas void of the micro planar conductor 100 on the basis of a rectangle or a regular polygon equivalent to each micro planar conductor.

The embodiment may use a punching process to fabricate the planar array antenna 1 from the conductor plate 10, preventing any micro planar conductor 100 from being separated from the conductor plate 10. As a whole, the flat shape of the planar array antenna 1 can be maintained. The planar array antenna 1 can be punched out of the conductor plate 10. The sixth embodiment can provide an effect of saving manufacturing costs of the antenna in addition to the effects of the first embodiment and the others.

Seventh Embodiment

Figure 9A:
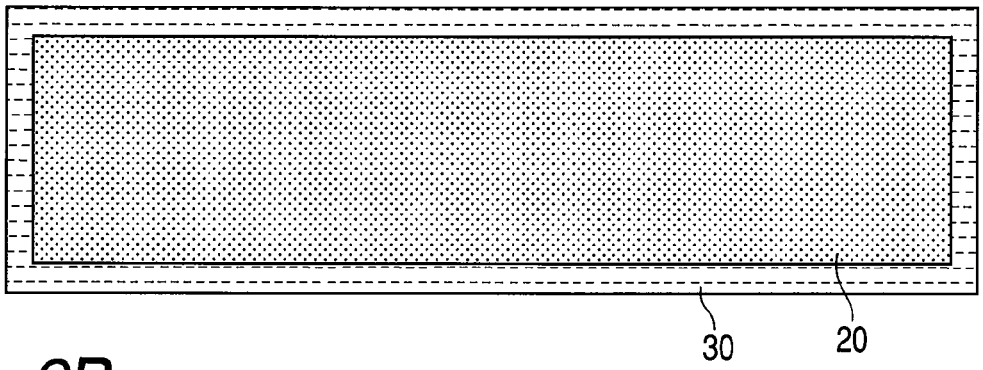
FIG. 9A shows a dielectric sheet and a conductor sheet for fabricating a planar array antenna according to a seventh embodiment of the invention.
Figure 9B:
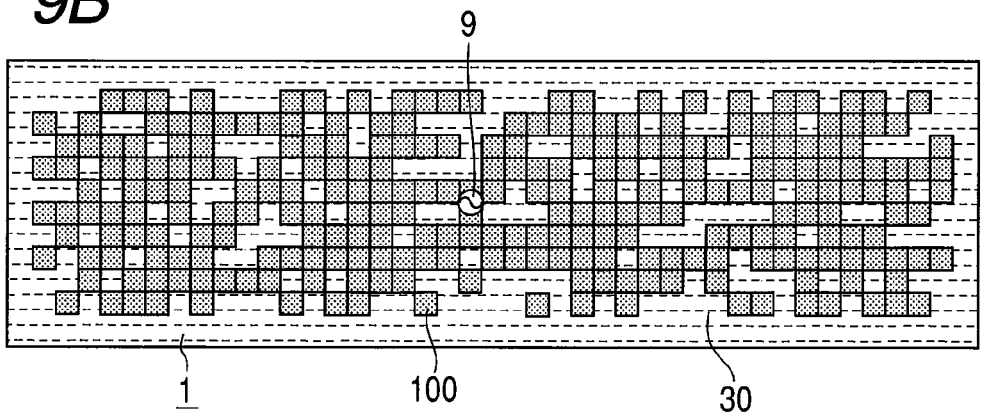
FIG. 9B shows a conductor pattern of the planar array antenna according to the seventh embodiment of the invention.

The seventh embodiment of the invention will be described with reference to FIGS. 9A and 9B. FIG. 9A shows a dielectric sheet and a conductor sheet for fabricating a planar array antenna 1. FIG. 9B shows a conductor pattern of the planar array antenna according to the seventh embodiment of the invention.

The planar array antenna according to the seventh embodiment uses the same design concept as the planar array antenna according to the embodiment in FIGS. 1A to 1C. As shown in FIG. 9A, a conductor sheet 20 is bonded to a dielectric sheet 30 so as to be used as a material for the planar array antenna. An etching process is used to pattern the conductor sheet 20 in accordance with the contrasting density of patterns as described in the first embodiment or elsewhere. As a result, the conductor pattern comprised of small planar conductor elements 100 is formed on the dielectric sheet 30. The feeding point 9 may be galvanically short-circuited by the short-circuiting closed path 5 configured to be shorter in length.

The planar array antenna 1 according to the embodiment may be expressed as the continuously flat conductor (conductor sheet 20) lined with the dielectric material (dielectric sheet 30) including scientifically or physically partly cut regions or areas void of the micro planar conductor 100 on the basis of a rectangle or a regular polygon equivalent to each micro planar conductor.

The embodiment can configure the planar array antenna 1 using a chemical photo-etching process capable of high-precision and mass production. The seventh embodiment provides not only the effect of the first embodiment or elsewhere but also an effect of mass-producing the antenna and improving the yield to save manufacturing costs of the antenna.

Eighth Embodiment

Figure 10A:
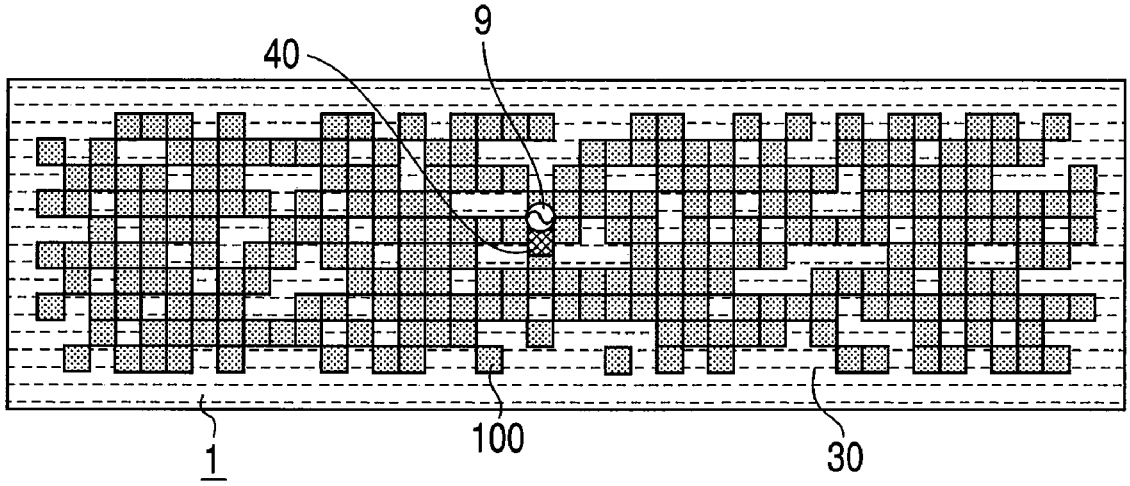
FIG. 10A shows a structure of an inlet using a planar array antenna according to an eighth embodiment of the invention.

The eight embodiment of the invention will be described with reference to FIGS. 10A and 10B. FIG. 10A shows a structure of an inlet using a planar array antenna according to the eighth embodiment of the invention. For example, the inlet is formed by directly connecting a semiconductor chip 40 to the feeding point 9 of the planar array antenna 1 fabricated in accordance with the embodiment in FIGS. 9A and 9B.

Figure 10B:
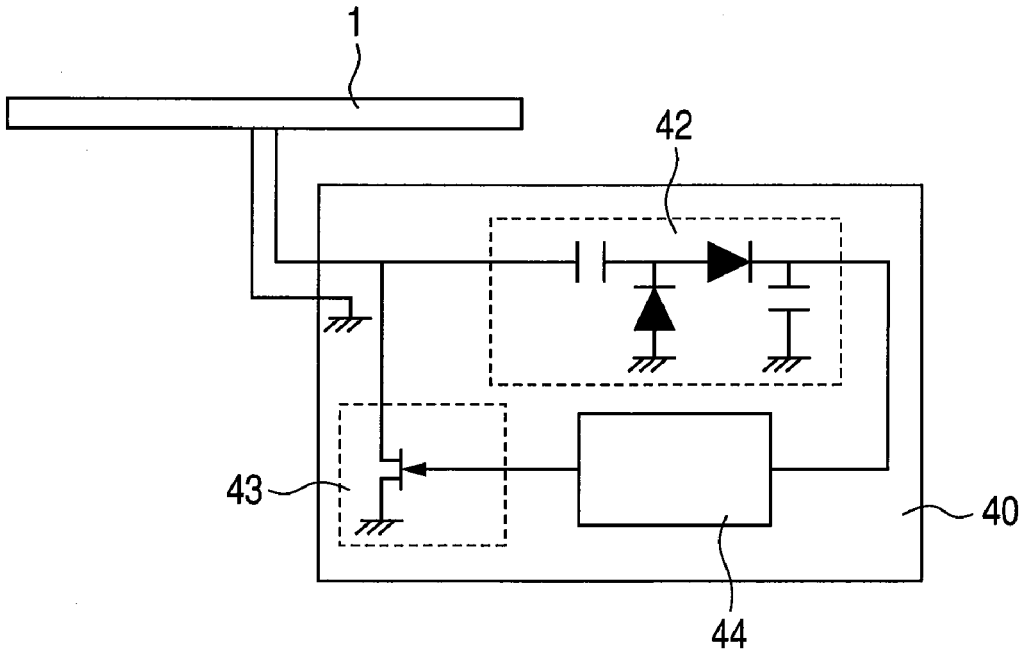
FIG. 10B shows an RFID tag as an example of a semiconductor chip according to the eighth embodiment of the invention.

FIG. 10B shows an RFID tag as an example of the semiconductor chip 40. The RFID tag is formed of an IC chip 0.4 millimeters square, for example. The chip is provided with only a wireless communication function and a ROM function. A unique ID number is stored in a ROM of the RFID tag 40 and is transmitted to a reader at a base station. The RFID tag 40 is bonded to the planar array antenna 1 and is used as an inlet. The planar array antenna 1 receives energy of an electromagnetic wave transmitted from the base station. The RFID tag 40 allows a rectifier circuit 42 to convert the energy into a direct-current power. A microprocessor 44 operates on the direct-current power and drives a modulation circuit 43. The modulation circuit 43 modulates a load impedance of the antenna 1. The antenna 1 radiates an electromagnetic wave equivalent to the amplitude-modulated receiving wave. In this manner, the RFID tag 40 provides a function of transmitting its own ID number to the base station.

Since the array antenna 1 uses no feed line, the embodiment solves degradation of array antenna characteristics due to radiation of an electromagnetic wave in an undesired direction and eliminates the need for a structure that shields the feed line. The planar array antenna according to the embodiment and the semiconductor chip are capable of mass production, providing a cost-effective terminal station for the wireless system such as the RFID tag.

Ninth Embodiment

Figure 11:
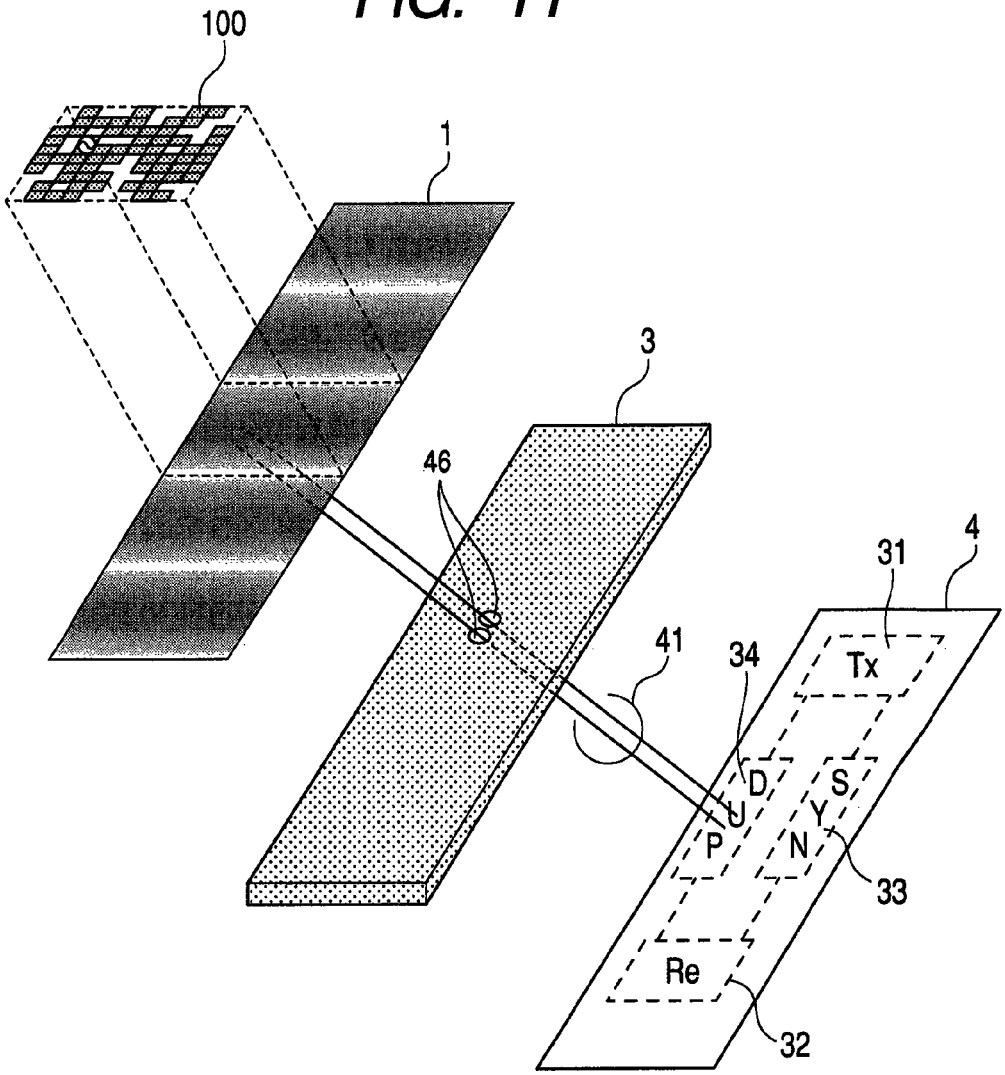
FIG. 11 shows a structure of a wireless module using a planar array antenna according to a ninth embodiment of the invention.
Figure 12:
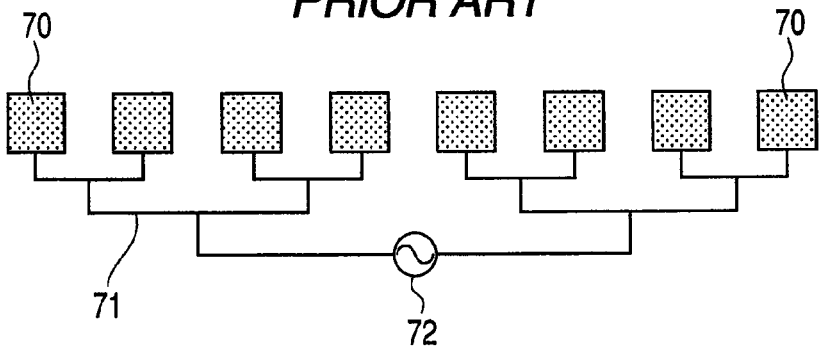
FIG. 12 PRIOR ART
FIG. 12 shows an example configuration of a conventional array antenna.

The ninth embodiment of the invention will be described with reference to FIG. 11. FIG. 11 shows a structure of a wireless module using a planar array antenna according to the ninth embodiment of the invention. The wireless module according to the embodiment includes the planar array antenna 1 on a surface layer of a laminate structure. A conductor pattern including a set of small planar conductor elements 100 is formed on the surface layer of a dielectric base layer 3. A reverse layer (high-frequency circuit formation layer) 4 of the dielectric base layer 3 is provided with a transmission circuit 31, a reception circuit 32, a frequency synthesizer 33, and a duplexer 34. A feeding point of the planar array antenna 1 on the surface layer passes through a connection hole 46 in the dielectric base layer 3. The feeding point is connected with the duplexer 34 on the reverse layer through the use of a very short feed line 41. A power supply circuit (not shown) supplies power to the planar array antenna 1 and the high-frequency circuit formation layer 4.

The frequency synthesizer 33 supplies a sine wave signal having a specified frequency to the transmission circuit 31 and the reception circuit 32 on the high-frequency circuit formation layer 4. The transmission circuit 31 and the reception circuit 32 are connected with the duplexer 34. The duplexer 34 is electrically connected with the antenna 1 and transmits a signal received by the antenna 1 to the reception circuit 32. The duplexer 34 supplies the antenna 1 with an output from the transmission circuit 31.

According to the embodiment, the planar array antenna structure is formed on the surface layer of the dielectric base layer 3. The high-frequency wiring structure is formed on the reverse layer (high-frequency circuit formation layer) 4 thereof. The structures are equivalent to conductor patterns formed on the surface and the reverse of the dielectric base layer 3. A series of multi-layer substrate processes can be used to easily form the conductor patterns. The embodiment can provide a cost-effective high-frequency module with a built-in antenna for a wireless system such as an RFID reader.

What is claimed is:

1. A planar array antenna array antenna comprising:

a set of small planar conductor elements distributed in a plane, wherein a density of distribution of the small planar conductor elements has a periodicity of variation in a specified length direction corresponding to a given azimuth angle with reference to a normal line belonging to the plane, wherein a part of the small planar conductor elements is configured as a feeding point, and wherein the density of distribution of the small planar conductor elements varies at a cycle of $n \times \lambda/2$, where $\lambda$ is an operating wavelength and n is a natural number.

2. The planar array antenna according to claim 1, wherein each of the small planar conductor elements functions as a radiation conductor and a feed line for an antenna.

3. The planar array antenna according to claim 1, further comprising:

a single specified length direction corresponding to the azimuth angle, wherein a one-dimensional contrasting density of patterns results from presence or absence of the small planar conductor elements.

4. The planar array antenna according to claim 1, wherein the azimuth angle is associated with two length directions orthogonal to each other, and wherein a two-dimensional contrasting density of patterns results from presence or absence of the micro planar conductor.

5. The planar array antenna according to claim 1, wherein each of the small planar conductor elements has a planar shape of a rectangle or a regular polygon.

6. The planar array antenna according to claim 2, wherein each of the small planar conductor elements has a planar shape of a rectangle or a square, and wherein one of the small planar conductor elements is in contact with an adjacent one of the small planar conductor elements via at least one common edge to configure the feed line.

7. The planar array antenna according to claim 1, wherein each of the small planar conductor elements is configured as a thin film made of a conductive material such as a metal material, conductive paste, or conductive ink.

8. The planar array antenna according to claim 2, wherein the feeding point is configured in such a manner that all of the small planar conductor elements except for the part of the small planar conductor elements configuring the feeding point share at least one edge with a subset of the small planar conductor elements.

9. The planar array antenna according to claim 1, wherein the part of the small planar conductor elements configuring the feeding point is galvanically short-circuited by a short-circuiting closed path that is configured by the other small planar conductor elements.

10. The planar array antenna according to claim 1, wherein a continuously flat conductor is irregularly formed to include a plurality of holes based on a rectangle or a regular polygon equivalent to the small planar conductor elements.

11. The planar array antenna according to claim 1, wherein a conductor pattern including the plurality of small planar conductor elements is formed on one dielectric sheet.

12. The planar array antenna according to claim 1, wherein a continuously flat conductor is lined with a dielectric material and includes a region that is scientifically or physically removed based on a regular polygon equivalent to the small planar conductor elements.

13. The planar array antenna according to claim 5, wherein each edge of the small planar conductor elements is one fiftieth of an operating wavelength or shorter.

14. A planar array antenna array antenna comprising:

a set of small planar conductor elements distributed in a plane, wherein a density of distribution of the small planar conductor elements has a periodicity of variation in a specified length direction corresponding to a given azimuth angle with reference to a normal line belonging to the plane, wherein a part of the small planar conductor elements is configured as a feeding point, wherein a variation of the density of distribution is equivalent to a cyclical repetition of a contrasting density of patterns, wherein a presence of the small planar conductor elements corresponding to a dark part of the contrasting density of patterns occupies approximately 80% of a corresponding discrete region, and wherein a presence of the small planar conductor elements corresponding to a light part thereof occupies approximately 40% of a corresponding discrete region.

15. A wireless module comprising:

a planar array antenna on a surface layer of a laminate structure, wherein the planar array antenna includes a set of small planar conductor elements distributed in a plane, wherein a density of distribution of the small planar conductor elements has a periodicity of variation in a specified length direction corresponding to a given azimuth angle with reference to a normal line belonging to the plane, wherein a part of the small planar conductor elements is configured as a feeding point, wherein a surface layer of a dielectric base layer is formed of a conductor pattern as a set of the small planar elements of conductor for the planar array antenna, wherein a transmission circuit, a reception circuit, a frequency synthesizer, and a duplexer are formed on a high-frequency circuit formation layer configuring a reverse layer of the dielectric base layer, and wherein the feeding point of the planar array antenna provided on the surface layer passes through a connection hole in the dielectric base layer and is connected to the duplexer on the reverse layer via a feed line.

* * * * *